United States Patent [19]

Thompson

[11] Patent Number: 4,795,394

[45] Date of Patent: Jan. 3, 1989

[54] MARBLE TOY

[76] Inventor: James W. Thompson, 1513 Park La., Augusta, Kans. 67010

[21] Appl. No.: 49,599

[22] Filed: May 14, 1987

[51] Int. Cl.[4] ..... A63H 29/08

[52] U.S. Cl. ..... 446/168; 446/173

[58] Field of Search ..... 446/168, 169, 166, 167, 446/170, 171, 172, 173

[56] References Cited

U.S. PATENT DOCUMENTS

| | | | |
|---|---|---|---|
| 409,806 | 8/1889 | Schuremann | 446/170 X |
| 1,244,457 | 10/1917 | Bain | 446/173 |
| 1,279,270 | 9/1918 | Cole | 446/168 |
| 1,355,665 | 10/1920 | Guttridge | 446/169 |
| 1,518,144 | 12/1924 | Huggins | 446/167 |
| 1,534,097 | 4/1925 | Wilhelm et al. | 446/173 |
| 2,325,689 | 8/1943 | Le Blanc | 446/169 |
| 2,419,990 | 5/1947 | Dishmaker | 446/169 X |
| 2,531,564 | 11/1950 | Garbe | 446/173 |
| 4,348,028 | 9/1982 | Barlow | 446/168 X |
| 4,359,837 | 11/1982 | Hool | 446/171 |

FOREIGN PATENT DOCUMENTS

| | | | |
|---|---|---|---|
| 360286 | 11/1931 | United Kingdom | 446/169 |

*Primary Examiner*—Robert A. Hafer
*Assistant Examiner*—D. Neal Muir
*Attorney, Agent, or Firm*—John Wade Carpenter

[57] ABSTRACT

A toy having a base, a support bound to the base, and a lever pivotally secured to the support. A trough is connected to the support and has a zig-zag channel terminating into a generally straight channel. A plunger is slidably disposed in the trough at the end of the generally straight channel. A method for moving a spherical object from a higher elevation to a lower elevation.

11 Claims, 1 Drawing Sheet

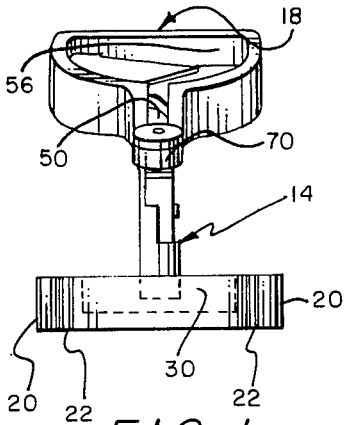
FIG. 1
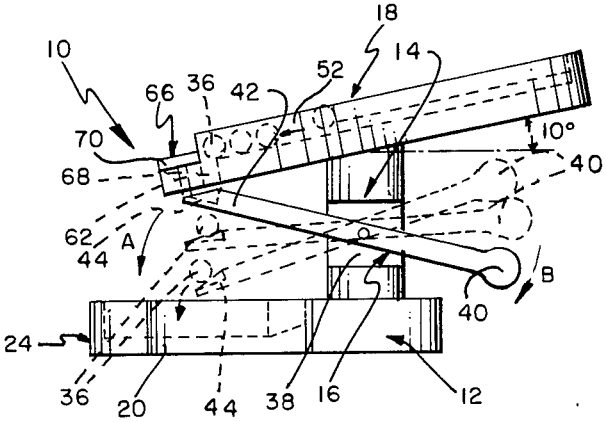
FIG. 2
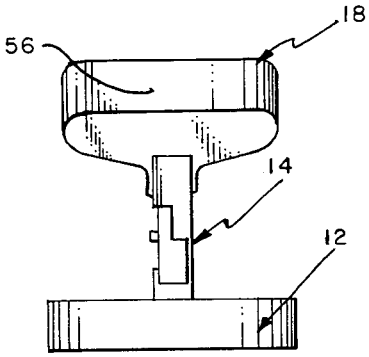
FIG. 3
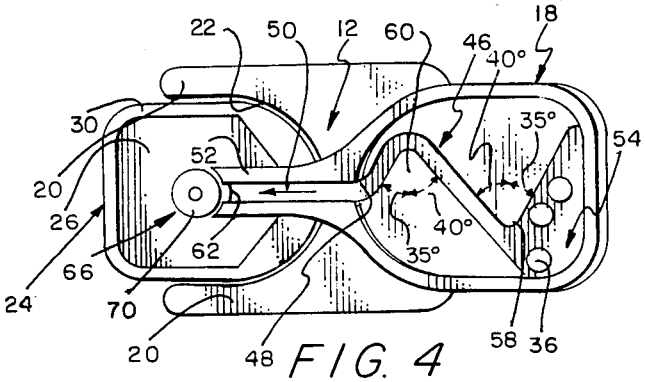
FIG. 4
FIG. 6
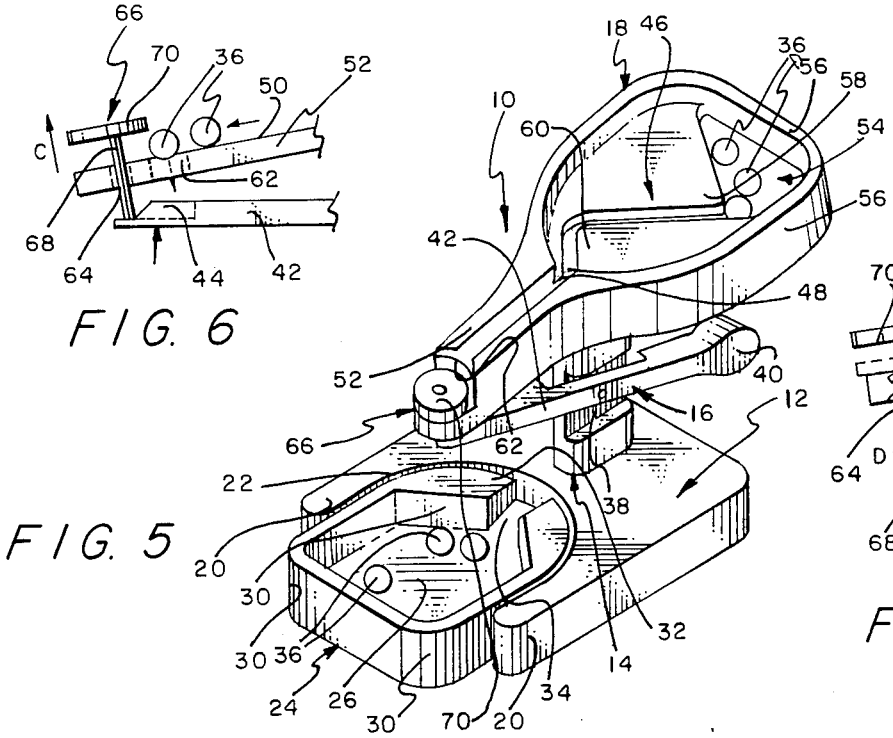
FIG. 5
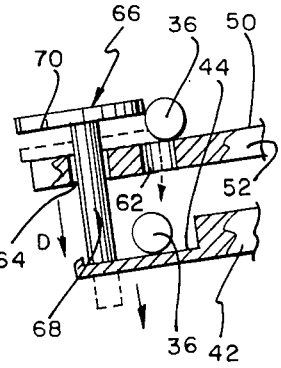
FIG. 7

MARBLE TOY

FIELD OF THE INVENTION

This invention is related to a toy. More specifically, this invention provides a toy primarily for executives, or the like, and to a method for moving spherical objects from a higher elevation to a lower elevation.

DESCRIPTION OF THE PRIOR ART

U.S. Pat. No. 1,617,846 to Hawks teaches a gravity toy. U.S. Pat. No. 1,739,719 by Gunderman illustrates an amusing gravity toy or game. U.S. Pat. No. 2,400,410 by Hatcher illustrates a marble runaway toy. U.S. Pat. No. 2,558,881 to Scharkoff provides for a marble shooting coaster toy with projector. U.S. Pat. No. 2,729,914 by Cook teaches a marble runway. U.S. Pat. No. 3,333,851 to Rosen discloses a game apparatus of the projected ball type wherein a ball or like projectile is propelled by a hand operated striker in a substantially vertical plane for gravitating movement past or onto successive slideway members projecting from a substantially vertical plane. U.S. Pat. No. 3,570,171 by Shook teaches an amusement device of the spherical ball type. None of the foregoing prior art patents teach or suggest the particular toy of this invention.

SUMMARY OF THE INVENTION

The present invention accomplishes its desired objects by broadly providing a method for moving spherical objects from one elevation to another elevation comprising the steps of:

(a) rolling in a zig-zag course down an inclined surface at least one spherical object;

(b) altering the course of the rolling spherical object from a zig-zag course to a straight course;

(c) rolling the spherical object down the straight course;

(d) stopping the rolling of the spherical object down the straight course with a plunger means; and (e) elevating the plunger means in order to release the spherical object through an opening in the straight course such that the spherical object falls downwardly into a tray means.

The present invention further accomplishes its desired objects by further broadly providing a toy having a base means and a support means bound to said base means. A lever means is pivotally secured to the support means and a trough means is connected to the support means and has a structure defining a generally zig-zag channel terminating into a generally straight channel. A plunger means is slidably disposed through a plunger aperture at the end of the generally straight channel.

Therefore, it is an object of the invention to provide a toy.

It is another object of this invention to provide a method for moving spherical objects from one elevation to another elevation that is lower than the first elevation.

These, together with the various ancillary objects and features which will become apparent to those skilled in the art as the following description proceeds, are attained by this novel toy and method, a preferred embodiment being shown with reference to the accompanying drawings, by way of example only, wherein:

BRIEF DESCRIPTION OF THE DRAWINGS

FIG. 1 is a front elevational view of the toy;

FIG. 2 is a side elevational view of the toy with various positions of the lever represented by dotted lines;

FIG. 3 is a back elevational view of the toy;

FIG. 4 is a top plan view of the toy;

FIG. 5 is a perspective view of the toy;

FIG. 6 is a partial sectional view of the recessed end of the lever raising the plunger to allow a spherical object to drop through an opening in the straight channel of the trough of the toy; and FIG. 7 is a partial sectional view of the recessed end of the lever being lowered by the weight of the spherical object resting therein after having passed through the opening in the straight channel of the trough, and of the top of the plunger engaging the next in line spherical object and covering partially the opening in the straight channel to prevent the same from immediately falling through the opening.

DETAILED DESCRIPTION OF THE INVENTION

Referring in detail now to the drawings wherein similar parts of the invention are identified by like reference numerals, there is seen the toy generally illustrated as 10, of this invention comprising a base, generally illustrated as 12, supporting a support, generally illustrated as 14, bound to the base 12. A lever, generally illustrated as 16, is pivotally connected to the support 14, and a trough, generally illustrated as 18, is connected to and supported by the support 14. The trough 18 is included with respect to a horizontal plane from about 3° to about 30°, preferably 10° (see FIG. 2).

The base 12 has an end that terminates into a pair of base arms 20—20 such that the base 12 has a structure defining a generally U-shaped recess 22. A tray, generally illustrated as 24, is arcuately shaped on one end in order to be slidably disposed within the U-shaped recess. More specifically with respect to the tray 24, the tray has a bottom 26 with a perimeter 28 and an upright wall 30 attached to the bottom 26 and extending thereabove along the perimeter 28 of the bottom 26. The upright wall 30 is interrupted by an opening, generally illustrated as 32, with a wall bottom 34 (see FIG. 5) that slants from the bottom 26 of the tray 24 upwardly at an incline through the upright wall 30 and terminates on the outside surface of the upright wall 30 such that the opening 32 provides a tray spout for the tray 24 wherethrough spherical objects (e.g. spherical balls 36) may be rolled from the tray 24.

the support 14 has a recess 38 wherein the lever 16 pivotally connects to the support 14. The lever 16 has a weighted end 40 and an end 42 having a recess 44 wherein the spherical balls 36 fall from the trough 18 to be discharged eventually into the tray 24, as further explained below with more specificity.

The trough 18 has a zig-zag channel, generally illustrated as 46, that terminates at 48 into at generally straight channel 50 that is in a neck 52 of the trough 18. The zig-zag channel 46 communicates with a trough recess, generally illustrated as 54, that is surrounded in part by an upright trough wall 56. Between the trough recess 54 and the zig-zag channel 46 is a first channel curve 58 that is approximately 75° (as illustrated in FIG. 2). The zig-zag channel 46 comprises a second channel curve 66 of approximately 75° that immediately communicates with the straight channel 50. The zig-zag channel 46, as well as the trough recess 54 and the straight channel 50 within the neck 52 of the trough 18, are slanted with respect to a horizontal plane from about 3° to about 30°, as was indicated for the trough 18 in general.

At the end of the straight channel 50 in the neck 52 of the trough 18 is a spherical object aperture 62 wherethrough spherical balls 36 leave the straight channel 50 and fall by gravity into the recess 44 in the end 42 of the lever 16. At the end of the neck 52 of the trough 18 and in close proximity to the spherical object aperture 62 is a plunger aperture 64 wherein a plunger, generally illustrated as 66, is slidably disposed. Plunger 66 comprises a plunger shaft 68 and a plunger head 70 integrally bound to the plunger shaft 68. The plunger shaft 68 slidably lodges within the plunger aperture 64 such that when the plunger head 70 is supported by and flushed against the top surface at the end of the neck 52, the plunger head 70 extends partially over the spherical object aperture 62 (as illustrated in FIGS. 2, 4 and 7) and prevents the spherical balls 36, which roll by gravity through the straight channel 50, from falling through the spherical object aperture 62 until the end 42 of the lever 16 raises the plunger head 70 upwardly away from the spherical object aperture 62 by upward contact with the end of the plunger shaft 68, as will be explained further hereinafter. The diameter of the spherical balls 36 is slightly smaller than the diameter of the spherical object aperture 62, so typically the plunger head 70 has to extend over the spherical object aperture a sufficient distance such that the spherical balls 36 can not fall through the spherical object aperture 62 without the plunger head 70 being driven away from the spherical object aperture as illustrated in FIG. 6.

With continuing reference to the drawings for operation of the invention and the method for moving spherical balls 36 from one elevation to another elevation, spherical balls 36 are placed in the recess trough 54 of the trough 18. Since the trough 18 is preferably inclined at about 10°, the spherical balls 36 begin to gravity feed (some around the first channel curve 58) into the zig-zag channel 46 where the spherical balls 36 flow in a zig-zag fashion through the zig-zag channel 46. When the spherical balls 36 reach the end of the zig-zag channel 46 at 48, the zig-zag course of the spherical balls 36 is altered into a straight course which is conducted by the straight channel 50 wherethrough the spherical balls 36 roll and stop upon coming to rest against the plunger head 70 and partially over the spherical object aperture, as illustrated in FIG. 2. To start the toy 10 moving after at least one spherical ball 36 is resting against the plunger head 70, end 42 of level 16 (which is normally in the position of FIG. 2 because of the weight of the weighted end 40) is depressed downwardly in direction of arrow A in FIG. 2 and subsequently released, causing the weighted end 40 of lever 16 to travel downwardly in direction of the arrow B in FIG. 2. As weighted end 40 of lever 16 travels in direction of the arrow B, end 42 of lever 16 travels upwardly in a direction opposite to the direction of arrow A, causing the end 42 of lever 16 to eventually come in contact with the bottom of the plunger shaft 68 of the plunger 66. This causes the plunger 66 including its plunger head 70 to be driven upwardly in direction of the arrow C in FIG. 6. When the plunger head 70 passes over a spherical ball 36, the entire diameter of the spherical object aperture 62 opens up for a first in-line spherical ball 36, which enables the latter to fall freely through the spherical object aperture 62 and immediately into the recess 44 of the end 42 to interrupt the fall of the spherical ball 36. When the spherical ball 36 strikes the bottom of the recess 44 in the end 42 of the lever 16, the force and weight of the spherical ball 36 causes the end 42 of the lever 16 to be driven downwardly again in direction of the arrow A (see dotted line positions of lever 16 in FIG. 2). Plunger 66 including its plunger head 70 follows immediately downward in direction of the arrow D in FIG. 7 to the dotted line position in FIG. 7 and the solid line position in FIGS. 2 and 5, preventing a second in-line subsequent spherical ball 36 from immediately following the first in-line spherical ball 36.

As the end 42 of lever 16 approaches the tray 24, the first in-line spherical ball 36 rolls out of recess 44 by gravity and into the tray 24. With this release of weight, the end 42 starts traveling upwardly again (from the weighted end 40 moving downwardly in direction of arrow B) in a direction opposite to the direction of the arrow A. The entire process is subsequently repeated causing the second in-line spherical balls 36 thereto to fall through the spherical object aperture 62. The process continues as long as there are spherical balls 36 available to be released through spherical object aperture 62. The toy 10 may somewhat perpetually operate from spherical balls 36 falling through the spherical ball aperture 62, striking and lodging in the recess 44 of the end 42 of lever 16 which sends the same downwardly in direction of the arrow A, and rolling away therefrom from gravity, causing the end 42 to be sent upwardly to receive another spherical ball 36. The trough 18 may be replenished of spherical balls 36 by lifting or raising the tray 24 and rolling the spherical balls 36 from the tray 24 into the trough 18.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A toy comprising a base means; a support means bound to said base means; a lever means pivotally secured to said support means; a trough means connected to the support means and having a structure defining a generally zig-zag channel terminating into a generally straight channel; and a plunger means slidably disposed through the trough means at the end of the generally straight channel;

said plunger means comprises a plunger head and a plunger shaft integrally secured to said plunger head;

said trough means comprises a plunger aperture wherethrough said plunger shaft passes to extend outwardly therefrom and a spherical object aperture in close proximity to said plunger aperture such that as said plunger shaft is slidably disposed in said plunger aperture said plunger head extends partially over and intermittently obstructing said spherical object aperture; and said lever means intermittently contacting said plunger shaft to elevate said plunger head for removal of said obstruction said support means has a structure defining a support recess generally immediately below said trough means and said lever means is pivotally secured to said support means in said support recess below said trough means.

2. The toy of claim 1 wherein said base means comprises a base end terminating into a pair of base arms such that said base means has a structure defining a generally U-shaped recess.

3. The toy of claim 2 additionally comprising a tray means slidably disposed within said U-shaped recess.

4. The toy of claim 3 wherein said tray means comprises a tray bottom; an upright wall attached to the tray bottom and extending thereabove along the perimeter of the tray bottom, said upright wall having a wall opening with a wall bottom that slants from the bottom of the tray bottom upwardly through the upright wall and terminating on the outside surface of the upright wall such that the wall opening generally provides a tray spout for the tray means wherethrough spherical objects may be rolled from the tray means.

5. The toy of claim 1 wherein said lever means has a pair of lever ends, one lever end is weighted and the other lever end contains a recess.

6. The toy of claim 1 wherein said trough means is slanted with respect to a horizontal plane from about 3° to about 30°.

7. The toy of claim 6 wherein said trough means comprises an upright trough wall and a trough recess that communicates directly with the zig-zag channel and surrounded in part by the trough wall.

8. The toy of claim 1 comprising a first channel curve of approximately 75° between said zig-zag channel and said trough recess, and said zig-zag channel comprises a second channel curve of approximately 75° that immediately communicates with said straight channel.

9. The toy of claim 8 wherein said trough recess, said zig-zag channel and said straight channel are slanted with respect to a horizontal plane from about 3° to about 30°.

10. The toy of claim 6 additionally comprising a plurality of spherical objects rollably disposed within said trough means for rolling down the zig-zag channel and down the straight channel.

11. A toy comprising a base means; a support means bound to said base means; a lever means pivotally secured to said support means; a trough means connected to the support means and having a structure defining a generally zig-zag channel terminating into a generally straight channel; and a plunger means slidably disposed in the trough means at the end of the generally straight channel; said base means comprises a base end terminating into a pair of base arms such that said base means has a structure defining a generally U-shaped recess; a tray means slidably disposed within said U-shaped recess; said tray means comprises a tray bottom; an upright wall attached to the tray bottom and extending thereabove along the perimeter of the tray bottom, said upright wall having a wall opening with a wall bottom that slants from the bottom of the tray bottom upwardly through the upright wall and terminating on the outside surface of the upright wall such that the wall opening generally provides a tray spout for the tray means wherethrough spherical objects may be rolled from the tray means; said lever means has a pair of lever ends, one lever end is weighted and the other lever end contains a recess; said support means has a structure defining a support recess positioned generally immediately below said trough means; said lever means is pivotally secured to said support means in said support recess; said plunger means comprises a plunger head and a plunger shaft integrally secured to said plunger head; and said trough means comprises a plunger aperture wherethrough said plunger shaft passes to extend outwardly therefrom and a spherical object aperture in close proximity to said plunger aperture such that as said plunger shaft is slidably disposed in said plunger aperture said plunger head extends partially over said spherical object aperture intermittently obstructing said aperture; said lever means intermittently contacting said plunger shaft to elevates said plunger head for removal of said obstruction.

* * * * *